United States Patent [19]

Remme

[11] Patent Number: 4,609,191

[45] Date of Patent: Sep. 2, 1986

[54] ARCHERS EXERCISER

[76] Inventor: LeRoy A. Remme, 8635 N. Clayton Ave., Neenah, Wis. 54956

[21] Appl. No.: 535,076

[22] Filed: Sep. 23, 1983

[51] Int. Cl.[4] ..... A63B 21/02

[52] U.S. Cl. ..... 272/137; 272/67; 272/143

[58] Field of Search ..... 272/135, 141, 142, 126, 272/136, 93, 137, 67, 68; 124/23, 24, 25, 90, 17, 22, 23 R; 434/247

[56] References Cited

U.S. PATENT DOCUMENTS

| | | | |
|---|---|---|---|
| 1,538,844 | 5/1925 | Titus | 272/135 |
| 2,118,114 | 5/1938 | Schenk | 272/142 |
| 3,747,593 | 7/1973 | Taylor | 272/142 |
| 4,090,706 | 5/1978 | Reda | 272/142 |

*Primary Examiner*—Richard J. Apley
*Assistant Examiner*—James Prizant
*Attorney, Agent, or Firm*—Russell L. Johnson

[57] ABSTRACT

This invention is an exercising device for use by archers as a practice aid and a means for strengthening the muscle groups used for drawing and holding the draw of a bow and as a warm up device preparatory for practice or shooting. The device is characterized by its compactness and substantially unitary construction. The device is a novel application of relatively slow recovery elastic type materials to provide a non snap back property to the device. The principle components for the device are; a continuous loop of slow recovery elastic belting passing through a tubular grip at one side and through a string block or rod at the other side and the string block is provided with means for attaching a bow string simulator of the user's choice.

3 Claims, 5 Drawing Figures

ARCHERS EXERCISER

BACKGROUND OF THE INVENTION

In bow hunting, an archer is often required to draw a bow and hold the draw until the intended target presents a favorable shot. This requires strength and staying power in muscle groups which are not ordinarily used in the manner they are used in archery. Archers frequently practice shooting at targets mounted on hay bales to sharpen their shooting skills and accuracy. They seldom, however, practice drawing a bow and holding that draw for a period of time. As a result, when hunting, and the holding of a draw for a length of time is required, fatigue often causes "creep" to diminish the draw which results in a shaky and/or uncertain release.

DISCUSSION OF THE PRIOR ART

The drawing of a bow is an asymmetrical action. That is, the muscle groups associated with bow arm are working in what may be called a pushing mode while the muscle groups associated with the bow string arm are working in what may be called a pulling mode.

The prior art provides exercising devices which may be placed in two broad categorie. The first is that group which might be referred to as symmetrical exercisers and which are general utility exercisers which will aid in the symmetrical development of the muscle groups used in archery. The second group are archer's exercisers which generally provide the simulation of the asymmetrical drawing requirements of a bow but have only limited use, if any, as symmetrical or general use exercisers.

In the first class, the most relevant prior art of which the inventor is aware is found in U.S. Pat. No. 4,023,808 to Hebert. Hebert teaches a symmetrical exerciser device having two equal and opposed grips and an elastic resistance means between the grips. Only in a general way could this device be employed to develop the muscles used for archery by placing the muscles in the same situation that they are employed in archery.

In the second class, the most relevant prior art of which the inventor is aware is found in U.S. Pat. No. 4,279,601 to Cobelli. Cobelli's device will serve many of the same functions of the instant invention for developing of the muscles used in archery under conditions closely approximating those encountered in field shooting. Only in a very limited way could this device be employed as a general exercise device.

In counter distinction, the instant invention provides the archer with a greater range of field shooting simulation analogues than the device of Cobelli while providing the full range of general exercise capabilities of the device of Hebert.

The prior art in general and the devices of Cobelli and Hebert in particular do not provide or teach the use of an elastic resistance member having a slow rate of recovery which is a safety consideration when holding a tensioning exercise to the point of fatigue. The use of a resilient member with a slow rate of elastic recovery permits the user, wearing the appropriate conventional arm and hand guards to safely practice his string release from a full draw. The prior art of record does not provide this capability. As yet another distinction over the prior art, the device of this invention permits the user to employ a variety of bow string simulators with the device of this invention to meet a range of particular practice and exercise needs and/or wants.

BRIEF DESCRIPTION OF THE INVENTION

The invention in its simplest form is characterized by a closed resistance loop of slow elastic recovery material such as urithane strapping and the like and the loop passes through a tubular bow grip simulator at one side of the loop and threads in and out of a rigid block which serves as a bow string simulator mount at the other side and the bow grip simulator and the bow string mount may serve as conventional grips when the exerciser is employed as a general fitness exerciser.

DETAILED DESCRIPTION OF THE INVENTION

In the figures, like numbers refer to like objects.

Exerciser 1 comprises; continuous elastic loop 2, tubular bow grip simulator 3, and bowstring simulator 4.

Loop 2 is a continuous loop of slow elastic recovery high hysteresis material such as Eagle Urithane Belting manufactured by Eagle Belting of Des Plaines, Ill., and the like. The resistance to stretch of loop 2 is a function of its length and the cross sectional area of the urithane belting material used to form loop 2.

The exerciser is assembled by passing a strand of elastic material through the components of grip simulator 3 threading it through the components of bow string simulator 4 and closing the loop by heat or chemical fusion to form loop 2.

Figure 1:
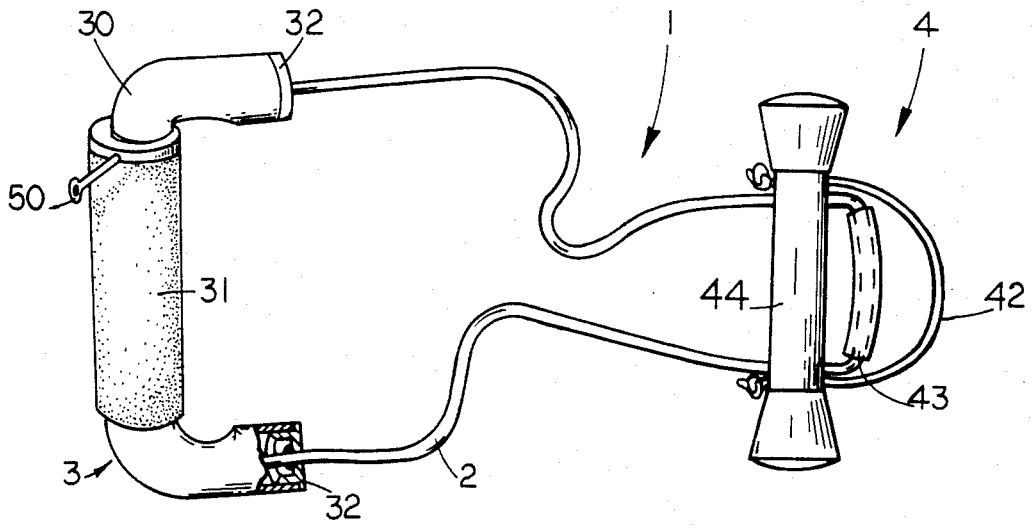
FIG. 1 is a pictorial view of a preferred embodiment of the device of this invention.
Figure 4:
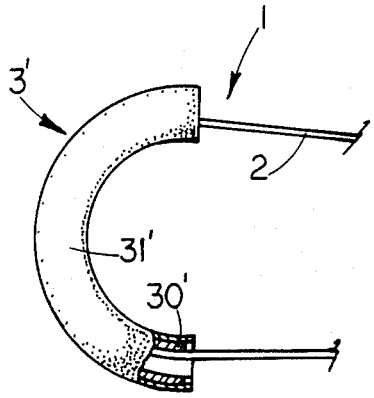
FIG. 4 is a partially sectioned pictorial view illustrating an alternate bow grip simulator.

Grip 3 may be of rigid tubular material such as tube 30 of FIG. 1 or it may be of yielding tubular material such as tube 30' of FIG. 4. Tube 31' is of stiffness similar to that of ordinary garden hose. Grips 3 and 3' are encased in a soft sponge sleeve 31 and 31' respectively. Grip 3 is provided with end caps 32 which serve to guide and restrain as well as reduce wear on loop 2.

Also threaded onto loop 2 is bow string simulator 4. In preparing for field shooting in bow hunting, it is desirable to strengthen the fingers for gripping the bow string and to develop calluses on the finger tips in the area pressed by the bow string.

Figure 2:
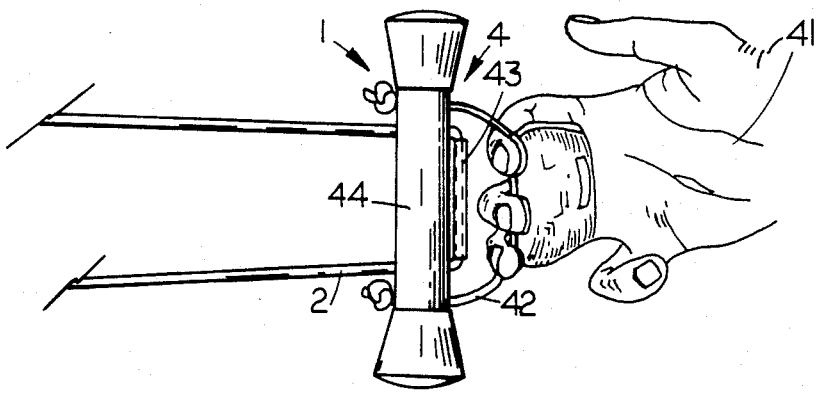
FIG. 2 is a partially sectional pictorial view illustrating one mode of use of the bow string simulator of this invention.
Figure 3:
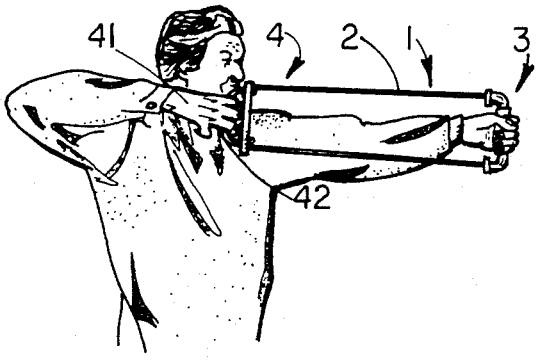
FIG. 3 is a pictorial view of the device of FIG. 1 in use as an archery training device.
Figure 5:
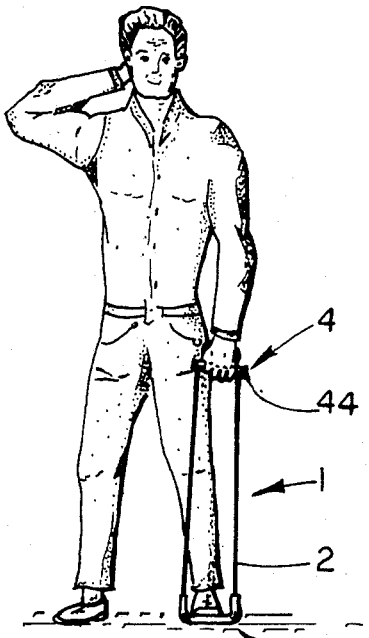
FIG. 5 is a pictorial view of the device of this invention in use as a general exercising device.

Bow string simulator 4 is provided for such exercising, warm up, training, and conditioning. The fingers of string hand 41 grip the string 42 in the manner shown in FIGS. 2 and 3. When it is the user's desire to toughen the finger tips to the bow string, string 2 is used. This mode of use, with the proper arm and hand guard also permits the practice of the string release which is critical to accurate bow shooting. The slow elastic recovery of loop 2 permits the safe release of a 30 pound or more draw. This type of practice has not been practical with prior art devices. When it is desired to practice drawing and holding a draw for exaggerated periods of time the "cut" of the string would be undesirable. To accommodate this mode of practice, loop 2 is provided with protective sleeve 43. Rod 44 serves as means of attachment for string 42 and also as a grip for use when the exerciser is used for general conditioning exercises such as that illustrated in FIG. 5.

In use certain enhancements of the invention are found to be desirable. For example, grip simulator 3 may be provided with a simple sight 50 to enable the user to practice maintaining a steady hold of the draw and to practice sighting while practicing his draw. As another example, grip sleeves 31 and 31' may be free to rotate about loop 2 so as to permit rotation of the grip when doing curling type exercises and the like.

The inventor has provided enabling disclosures of the best mode of making and using his invention. He has particularly pointed out the novelty of employing slow recovery elastic materials as the resistance element in his invention and the novel construction which permits great fidelity to the actual conditions found in using a bow while at the same time using the same construction provided a general utility exerciser device.

It should be understood that numerous variants of the disclosed invention are achievable without departing from the above described invention and therefore the scope of the instant invention should not be limited to that of the embodiments disclosed but should be limited only by the appended claims and all equivalents thereto which would become obvious to one skilled in the art.

I claim:

1. An exercise device of the type having opposing grips and a resilient element spanning the distance between the grips and comprising;

(1) a closed loop of slow recovery high hysteresis elastic material such as the urithane belting material supplied by Eagle Belting Co. of Des Plaines, Ill. and equivalents.

(2) a tubular grip simulator through which the belting is passed prior to forming the belting into a closed loop.

(3) a bow string simulator rod having a first end and a second end and the belting is passed through a hole in the rod near the first end and then back through a hole near the second end of the rod before the loop is closed, (4) a bow string simulator having a first end and a second end and the first end of the bow string simulator is fastened to the first end of the simulator rod and the second end of the bow string simulator is fastened to the second end of the simulator, and rod, and (5) the loop is closed to form a continuous belt by means of heat fusion, chemical fusion, and equivalent joining means.

2. The device of claim 1 wherein the portion of the loop which passes in and then out of bow string simulator rod is encased in a sleeve of tubing material.

3. The device of claim 1 wherein the grip simulator is of a stiff, material, and the grip simulator is encased in a padding material.

* * * * *